US010480887B2

(12) United States Patent
Fischer et al.

(10) Patent No.: US 10,480,887 B2
(45) Date of Patent: Nov. 19, 2019

(54) FASTENING DEVICE FOR WEAPON ACCESSORY

(71) Applicant: Dieter Christandl, Weiz (AT)

(72) Inventors: Oliver Fischer, Hard (AT); Robert Hofer, St. Ruprecht/Raab (AT); Alexander Haider, Albersdorf (AT); Josef Christandl, St. Ruprecht/Raab (AT); Dieter Christandl, Weiz (AT)

(73) Assignee: Dieter Christandl, Weiz (AT)

( * ) Notice: Subject to any disclaimer, the term of this patent is extended or adjusted under 35 U.S.C. 154(b) by 0 days.

(21) Appl. No.: 16/009,520

(22) Filed: Jun. 15, 2018

(65) Prior Publication Data

US 2018/0292162 A1 Oct. 11, 2018

Related U.S. Application Data

(63) Continuation of application No. PCT/EP2015/080309, filed on Dec. 17, 2015.

(51) Int. Cl.

| | |
|---|---|
| ***F41A 21/30*** | (2006.01) |
| ***F41A 21/32*** | (2006.01) |
| *F41G 11/00* | (2006.01) |

(52) U.S. Cl.

CPC ..... *F41A 21/30* (2013.01); *F41A 21/325* (2013.01); *F41G 11/003* (2013.01)

(58) Field of Classification Search

CPC ..... F41A 21/325; F41A 21/30
USPC ..... 89/14.4; 42/90
See application file for complete search history.

(56) References Cited

U.S. PATENT DOCUMENTS

| | | | | |
|---|---|---|---|---|
| 4,479,418 | A * | 10/1984 | Beretta | F41A 21/30 89/14.4 |
| 5,136,924 | A | 8/1992 | Förster et al. | |
| 7,194,836 | B1 * | 3/2007 | Urban | F41C 27/22 42/106 |
| 8,631,602 | B2 * | 1/2014 | Chupp | F41G 11/003 42/71.02 |
| 9,784,519 | B2 * | 10/2017 | Fischer | F41G 11/003 |
| 2015/0362276 | A1 | 12/2015 | Fischer | |

FOREIGN PATENT DOCUMENTS

| | | |
|---|---|---|
| DE | 41 01 171 A1 | 8/1991 |
| DE | 10 2013 107 115 A1 | 8/2014 |

OTHER PUBLICATIONS

International Search Report issued for corresponding International Patent Application No. PCT/EP2015/080309, dated Aug. 17, 2016.

* cited by examiner

*Primary Examiner* — Reginald S Tillman, Jr.
(74) *Attorney, Agent, or Firm* — Myers Wolin, LLC

(57) ABSTRACT

A fastening device is provided for fastening a silencer to a handgun, wherein the fastening device has a fastening rail for fastening the fastening device to a mounting rail of the firearm, and a fastening means for fastening the weapon accessory to the fastening rail, wherein a fastening plate, which stands perpendicular to the fastening rail, is arranged on the front end of the fastening rail, wherein a shot channel is designed in the fastening plate that, when the fastening device is fastened to the mounting rail, extends coaxially to the center axis of the barrel of the firearm, and the fastening plate has the fastening means. Also provided is a weapon accessory that is designed to be fastened to a fastening device.

15 Claims, 5 Drawing Sheets

FASTENING DEVICE FOR WEAPON ACCESSORY

CROSS REFERENCE TO RELATED APPLICATIONS

This application is a continuation of International Application No. PCT/EP2015/080309, filed on Dec. 17, 2015, the contents of which are incorporated by reference herein.

TECHNICAL FIELD

The invention relates to a fixing device for fixing gun accessories, in particular silencers, to a gun, in particular, a handgun. Further, the invention relates to gun accessories, in particular, silencers, which can be fixed to a fixing device according to the invention. Further, the invention relates to a gun, in particular, a handgun having a fixing device.

BACKGROUND

The term "handguns" relates to hand-held firearms, as blowback operated weapons, or gas operated weapons, pistols, and the like. The invention will be described by means of the example of a handgun, although the present invention is not limited to the latter and might just as well be implemented in long guns.

It is known to equip firearms with accessories or to attach accessories to guns. For example, it is known to attach a tactical light or a silencer, for example, to a pistol. Hereby, it is known to screw mount silencers via a screw thread at the front end of the barrel.

With respect to handguns with fixed barrels, the silencer only causes minor problems relating to the self-loading function of the gun.

With respect to handguns with moving barrel, maintaining the self-loading function has been found to be problematic. This is because a silencer screwed onto the barrel or the breech increases the mass which is returned during a shot, whereby the return velocity decreases from the barrel to the breech. This may result in the self-loading function of the gun either being stopped completely, or functional disorders occurring, because, for example, the ejection of the empty cartridge and/or the supply of a new cartridge may only take place incompletely and the gun does no longer lock completely. This is specifically problematic with respect to guns, which have a returning and tipping barrel, because here, the front end of the barrel and thus, the silencer also still has to be raised.

In practice, it has been tried to solve this problem by more light-weight or smaller silencers. This, however, has the disadvantage that with correspondingly light-weight silencers, the stability of the silencer decreases, and that with respect to smaller silencers, the sound-absorbing effect occasionally may deteriorate substantially.

A solution for this problem is, instead of connecting the silencer and the gun barrel to each other rigidly, to rather arrange a so-called pulse generator between the silencer and the gun barrel, which on the one hand, is connected to the silencer, and on the other hand is connected to the gun barrel, and which allows for an axial movement of the gun barrel relative to the silencer.

The use of pulse generators, however, has the disadvantage that these may easily get dirty and/or damages at the threads of the pulse generator may lead to an impairment of the function of the gun. Moreover, the production of the pulse generator is relatively complex and expensive, which negatively affects the price of a silencer.

For silencers, which are screwed directly onto the front end of the gun barrel as well as for silencers, which are fixed to the end of the gun barrel via a pulse generator, it is disadvantageous that the mounting of the silencer as well as the demounting of the silencer takes relatively much time. Further, during screw mounting of the silencer, it always has to be ensured that the latter is fixedly screwed.

Therefore, it is an object of this disclosure to provide solutions, which at least partly overcome the disadvantages known from prior art described above, and which allow for an easy, secure, and quick mounting or demounting of the silencer, and at the same time do not impair the self-loading function of the gun.

SUMMARY

This object may be solved by a fixing device for fixing gun accessories, in particular, silencers, to a gun, by a gun accessory, in particular, silencers, and by a gun according to the independent claims. Preferred embodiments of the invention are specified in the respective dependent claims.

Accordingly, a fixing device for fixing gun accessories, in particular, silencers, to a gun, in particular, a handgun is provided, wherein the fixing device comprises

- a fixation rail for fixing the fixing device to a mounting rail of the gun, and
- a fixation means for fixing the gun accessory to the fixation rail, Wherein

- at the front end of the fixation rail, there is arranged a fixation plate perpendicular to the fixation rail, wherein a shot channel is formed within the fixation plate which, with the fixing device being fixed to the mounting rail, runs coaxially with respect to the central axis of the barrel of the gun, and
- the fixation plate comprises the fixation means.

Thereby, a silencer can be fixed to the gun advantageously without the silencer having to be coupled to the barrel of the gun. Thus, the barrel is able to move independently of the silencer also with the silencer being attached to the gun.

The fixation means may comprise a groove extending at least partially circumferentially around the fixation plate, or a tongue of a tongue and groove connection extending at least partially around the fixation plate.

The groove or the tongue may be formed such that a tongue or a groove provided at the gun accessory or at the silencer can be brought into engagement with the groove or tongue of the fixation plate. Thereby, the silencer may be fitted on the fixation plate.

The fixation plate has a predetermined thickness such that side walls are formed between the front side and the rear side of the fixation plate. The groove or the tongue of the fixation plate preferably is provided at at least two opposing side walls of the fixation plate, wherein the gun accessory can be fitted on the fixation plate along the groove or tongue.

It is advantageous, if a locking means is provided at the fixation plate for locking the gun accessory fixed to the fixation plate.

The locking means may comprise at least one hole provided at at least one side wall, which corresponds to a borehole provided at the gun accessory, when the gun accessory is fixed to the fixation plate, wherein preferably, a safety bolt can be pushed through the hole and the borehole.

The locking means may also be formed as a snap lock or as clip-on connection, which can be manipulated manually for releasing the gun accessory from the fixation plate.

The fixation means may comprise an internal thread or a bayonet lock formed in the shot channel of the fixation plate in order to allow screw mounting of the gun accessory on the fixation plate.

It is advantageous, if the fixation plate and the fixation rail are formed as one piece or integrally.

At the rear end of the fixation rail, a support surface may be formed, which at least in sections rests at the front face of the trigger of the gun, when the fixing device is fixed to the gun. Thereby, the stability of the fixing device attached to the gun is increased, i.e., movement of the fixing device fixed to the gun relative to the gun is substantially prevented.

At the rear end of the fixation rail, two blades spaced apart from each other may be provided, which at least in sections protrude in axial direction at the support surface, and which are perpendicular with respect to the support surface, wherein the distance between the two blades with respect to each other is selected such that it substantially corresponds to the width of the front end of the trigger such that the front end of the trigger engages at least in sections substantially in a positive-locking manner with the two blades, when the fixing device is attached to the gun. Thereby, the stability of the fixing device fixed to the gun is even further increased.

A locking means may be provided at the fixation rail in order to lock the fixing device at the gun.

The locking means may comprise at least one locking rocker being arranged pivotably about a pivot axis at the rear end of the fixation rail, and being movable from a locking position to a release position, wherein the locking rocker basically is aligned in parallel to the longitudinal axis of the fixation rail, and, in a state in which the fixing device is fixed to the gun, can be brought into engagement with the trigger of the gun, in order to lock the fixing device at the gun.

According to an embodiment, the fixing device may comprise an adapter being arranged or which can be arranged coaxially with respect to the shot channel of the fixation plate at the side of the fixation plate facing away from the barrel of the gun, wherein the adapter comprises connecting means at the end facing away from the shot channel for connecting the adapter to a silencer.

The adapter and the fixation plate may be formed in one piece.

Alternatively, the adapter may be connected to the fixation plate releasably, wherein the adapter comprises connecting means at the end facing the shot channel for connecting the adapter to the fixation plate.

The connecting means may comprise an internal thread, an external thread, and/or a bayonet lock or a bayonet-lock-like lock.

Also, a gun accessory is provided which is fixable to a gun, in particular, a handgun, wherein the gun accessory comprises a groove or a tongue of a tongue and groove connection at the end portion facing the gun, which can be brought into engagement with a tongue or groove provided at the gun.

The end portion of the gun accessory may comprise walls projecting axially, wherein the groove or tongue is provided at the radially inner surface of the walls.

The axially protruding walls may extend parallel with respect to each other.

In particular, the gun accessory may be a silencer.

Further, a gun, in particular, a handgun comprising a fixing device is provided.

The fixing device and the gun, in particular, the handle of the gun may be provided in one piece or integrally.

Advantageously, a silencer is fixed or may be fixed to the fixing device.

BRIEF DESCRIPTION OF THE DRAWINGS

Details and features of the invention as well as concrete embodiments of the invention can be derived from the subsequent description in connection with the drawing, in which.

DETAILED DESCRIPTION

The fixing device for fixing a gun accessory to a gun described in the following has the advantage that the gun accessory may be fixed to the gun independently of the barrel/lock such that the function of the gun is not impaired. A further advantage is that, in particular, with respect to a silencer, due to the configuration of the fixing device, it can be ensured that vibration of the silencer, in particular, after firing a shot is substantially prevented. Thereby, a semi-automatic or fully automatic operation of the gun is enabled. In the following, the invention is described by means of the example of a silencer, wherein the invention is not delimited to this. Also tactical lights being accordingly configured or the like may be fixed to the fixing device. Further, also other sound-absorbing devices, as plastic bottles, may be fixed to the fixing device.

Figure 1:
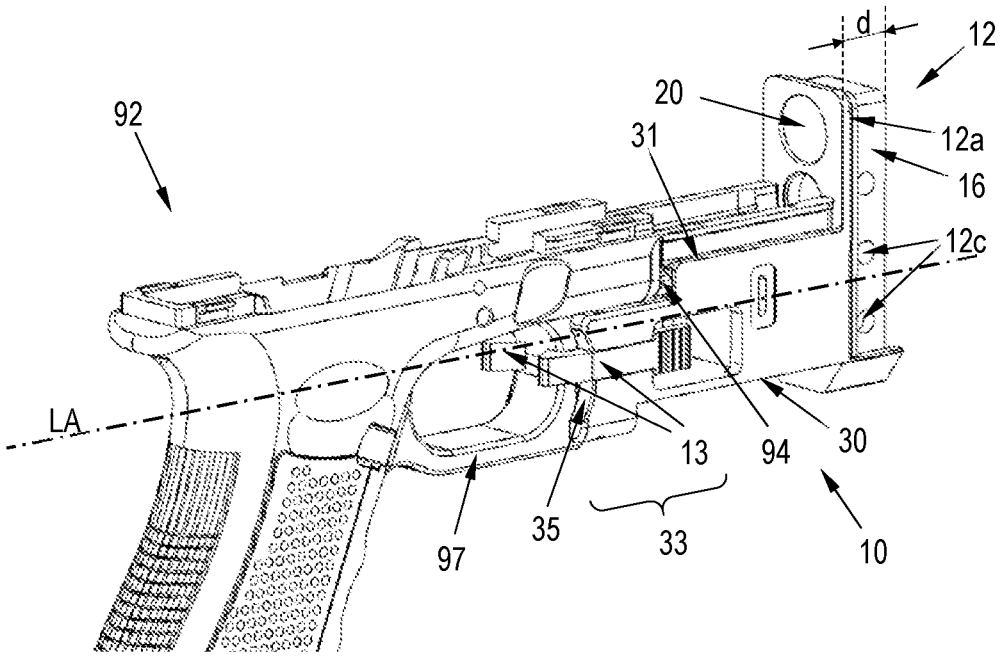
FIG. 1 shows a handle of a gun with a fixing device arranged thereon in a perspective oblique rear view.

FIG. 1 shows a handle 92 of a gun with a fixing device 10 arranged thereon in a perspective oblique rear view. For example, a silencer may be fixed to the fixing device 10.

The fixing device 10 comprises a fixation rail 30 and a fixation plate 12.

The fixation rail 30, in a mounted state of the fixing device 10, runs substantially parallel to the longitudinal axis LA of the gun or to the handle 92 of the gun. The fixation rail 30 is pushed on a mounting rail 94 of the gun, and by this, is fixed to the gun. The mounting rail 94, here, is arranged at the lower side of the front area of the handle 92, i.e., below the barrel of the gun. The fixation rail 30 has two side walls 31 extending axially and spaced apart from each other, at the inner surfaces of which guide grooves are provided, which can be brought into engagement with the mounting rail 94.

The fixation rail 30 and thereby, the entire fixing device 10 is locked at the gun or at the handles 92 of the gun by means of locking means in order to prevent an autonomous or unintended loosening of the fixing device 10 from the gun. The locking means, here, comprise one, preferably two locking rockers 13, which are arranged at the rear end of the fixation rail 30, and engage with the trigger 97 of the gun. The locking means are further described with respect to FIG. 2. With respect to FIG. 7, locking means being configured alternatively are described.

Further, the fixation rail 30 has two blades 35 at the rear end 33, between which a front end portion of the trigger 97 can be brought into engagement, when the fixing device 10 is fitted on the mounting rail 94. The blades 35 are described in further detail with reference to FIG. 2.

The fixation plate 12 is arranged at the front and of the fixation rail 30. The fixation plate 12 is arranged perpendicular with respect to the fixation rail 30. The fixation plate 12 and the fixation rail 30, preferably, are formed in one piece. However, they may also be formed in two pieces, in order to allow a releasing of the fixation plate 12 from the fixation rail 30. However, with respect to stability, a one-piece configuration is advantageous.

By the perpendicular arrangement of the fixation plate 12 at the fixation rail 30, the entire fixing device 10 has an L-shaped basic form, wherein the fixation rail 30 forms one leg of the L-shaped basic form and the fixation plate 12 forms the other leg of the L-shaped basic form. The angle, which is enclosed by the two legs measures about 90°.

As can be seen in FIG. 1, the fixation rail 30 extends below the barrel of the gun, while the fixation plate 12 is perpendicular with respect to the barrel, and is arranged axially in front of the barrel.

A shot channel 20 is formed in the fixation plate 12, the diameter of which substantially corresponds to the inner diameter of the barrel of the gun. Further, the shot channel is formed in the fixation plate 12 such that it is substantially coaxial with respect to the barrel, when the fixing device 10 is fixed to the gun.

The fixation plate 12 has a certain thickness d such that it comprises two opposing side walls 16. The two side walls run parallel with respect to each other and also are perpendicular with respect to the fixation rail 30. At the top side of the fixation plate 12, there is a wall, which extends between the two sidewalls. The upper one may be perpendicular with respect to the sidewalls 16 and may be formed planar, as is shown in FIG. 1, or may also describe and arc, i.e., it may have a certain radius of curvature.

Fixation means are provided at the fixation plate 12, by means of which the silencer or other gun accessories may be fixed to the fixation plate 12 releasably. The fixation means, in the embodiment of a fixing device 10 shown in FIG. 1, comprise a groove 12*a* of a tongue and groove connection. Such a groove 12*a* is provided at both sidewalls 16 of the fixation plate 12. The grooves 12*a* extend perpendicular with respect to the fixation rail 30. The gun accessory or the silencer has tongues corresponding to the grooves 12*a* such that the gun accessory or the silencer may be pushed onto the fixation plate 12, as shown, for example, in FIG. 8.

Alternatively, a tongue of a tongue and groove connection may also be provided at the fixation plate 12, while a corresponding groove is provided at the gun accessory or at the silencer.

At the upper side wall of the fixation plate 12, there also may be provided a groove or a tongue.

The tongue and groove connection between the fixation plate 12 and the silencer or gun accessory created, thereby, ensures that the silencer is not movable relative to the fixation plate 12 in axial direction.

A seal, for example a rubber seal, may be provided in the groove (of the fixation plate 12 or of the silencer 11), which prevents gas exiting from the silencer, as far as the silencer housing is open or partially open at the side facing the fixation plate 12. Advantageously, the silencer housing is closed at the side facing the fixation plate 12, and only has an opening for the shot channel.

In order to prevent a movement in radial direction relative to the fixation plate 12 of the fitted silencer, a corresponding locking means is provided. The locking means, here, is formed by boreholes 12*c* provided at the sidewalls 16, which correspond to the boreholes 40 at the silencer. After completely pushing the silencer onto the fixation plate 12, locking bolts may be pushed through the boreholes 40 of the silencer 11, and may be inserted into the boreholes 12*c* of the fixation plate 12.

Instead of boreholes/locking bolts, also a clip connection or snap-on connection may be provided, which is releasable manually.

With the fixing device 10, the barrel and the breech of the gun can move independently of the silencer fixed at the fixation rail 30 such that the silencer does not impair the self-loading function of the gun.

Figure 2:
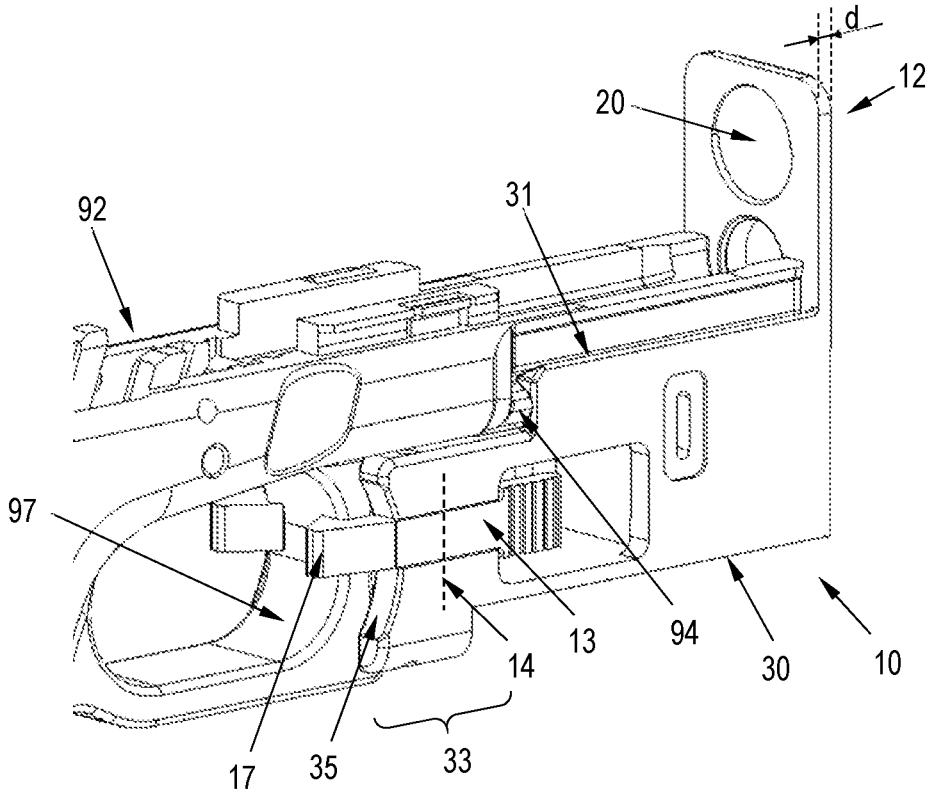
FIG. 2 shows an alternative embodiment of a fixing device being fixed to a gun in a perspective view.

FIG. 2 shows an alternative embodiment of a fixing device, which is fixed at a gun in a perspective view.

The fixation rail 30 of the fixing device 10 is identical to the fixation rail 30 shown in FIG. 1. The fixing device 10 according to FIG. 2 differs from the fixing device 10 according to FIG. 1 only in the concrete configuration of the fixation plate 12.

The fixation plate 12, here, is arranged perpendicular with respect to the fixation rail 30 at the front end of the fixation rail, and is arranged axially in front of the barrel of the gun. Also here, a shot channel 20 is formed in the fixation plate 12, which extends coaxially with respect to the barrel, when the fixing device 10 is fixed to the gun.

The fixation plate 12, however, has a smaller thickness d than the fixation plate 12 shown in FIG. 1.

The fixing of the gun accessory or of the silencer to the fixation plate 12, here, does not result from a tongue and groove connection, but rather by means of a screw connection. For this, an internal thread is provided in the shot channel 20 of the fixation plate 12, which corresponds to an external thread of the silencer. Then, the silencer may be screwed onto the fixation plate of the fixing device. A screwing of the silencer onto the barrel does not take place. Instead of a silencer, also other sound-absorbing devices may be screwed thereon, as plastic bottles or a container filled with a sound-absorbing material. Instead of a threaded connection between the silencer and the fixation plate, also a bayonet connection may be provided.

The rear end 33 of the fixation rail 30 has a support surface not shown in the figures, the surface of which substantially corresponds to the front face or front surface of the trigger 97. The front surface of the trigger 97, hereby, forms a counter-support surface for the support surface of the fixation rail 30. The support surface extends perpendicular between two blades 35 provided at the rear end 33.

The fixing device 10, for being fixed at the gun, is pushed completely onto the mounting rail 94 of the gun with the fixation rail 30 such that the support surface of the fixation rail 30 rests substantially flush at the counter-support surface of the trigger 97.

Locking rockers 13 are provided at the rear end 33 of the fixation rail 30, by means of which the fixing device 10 may be locked at the gun such that the fixing device 10 cannot loosen from the gun autonomously or inadvertently.

Figure 3:
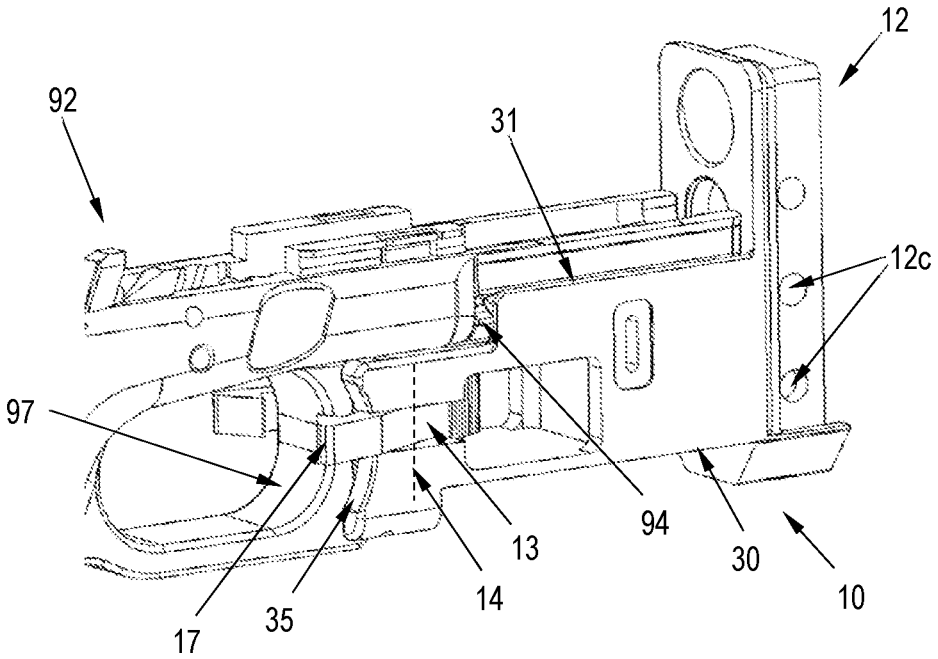
FIG. 3 shows the fixing device shown in FIG. 1 in a released state.

The locking rocker 13 runs substantially parallel to the longitudinal axis LA of the fixation rail 30. The locking rocker 13 is supported pivotably about a pivot axis 14 on the fixation rail 30 such that the locking rocker 13 can be brought from a locking position (as shown in FIG. 2) into a release position (as shown in FIG. 3). In the release position, the fixing device 10 may be pulled off the gun.

The locking rocker 13 is arranged at the rear and 33 of the fixation rail such that a portion of the locking rocker 13 protrudes beyond the rear end 33 of the fixation rail. The fixing device 10 is locked at the gun by means of the portion protruding beyond the rear end 33 of the fixation rail by bringing this portion into engagement with the trigger 97 of the gun.

A pin 17 is provided at the portion protruding beyond the rear end 33 of the fixation rail 30, which in the locking state, engages with the trigger 97, and thus, prevents an autonomous or unintended loosening of the silencer from the gun. Further, by engagement of the pin 17 with the trigger 97, the support surface of the fixation rail 30 is pushed against the counter-support surface of the trigger 97 such that the support surface rests securely on the counter-support surface. In a locked state, a horizontal movement of the fixing device 10 along the longitudinal axis of the gun is prevented.

The side of the pin 17 facing the trigger 97 has a surface, which is configured so as to slope downwards inwards. I.e., the angle enclosed by the surface and the longitudinal axis of the locking rocker 13 is smaller than 90°, preferably smaller than 75°, particularly preferred, approximately between 40° and 50°. Thereby, during fitting of the fixing device 10 onto the mounting rail of 94 of the gun, the inclined surface abuts against the trigger 97. Then, the trigger 97 pivots the pin 17 of the locking rocker 13 outwards, and the pin 17 slides past the trigger 97. After complete fitting of the fixing device 10 on the mounting rail 94 of the gun, the portion protruding beyond the rear end 33 of the fixation rail of the locking rocker 13 tilts back inwards such that the pin 17 engages with the trigger 97. Then, the locking rocker 13 is in the locking position. The inward tilting may be effected by a spring member, which belongs to the locking rocker 13.

In order to bring the locking rocker 13 into the release position, only the portion not protruding beyond the rear end 33 of the fixation rail has to be pushed inwards. The portion protruding beyond the rear end 33 of the fixation rail or the pin 17 then is pivoted about the pivot axis 14 outwards such that the pin 17 no longer engages with the trigger 97. Then, the fixing device 10 can simply be pulled off the gun.

Thereby, on the one hand, a particularly simple locking and a particularly simple releasing of the locking are enabled. On the other hand, the support surface of the fixation rail is pushed against the counter-support surface of the trigger 97.

By the support surface of the fixation rail 30, when mounted on the gun, resting on the counter-support surface of the trigger 97, and by the locking rockers 13 locking the fixing device 10 at the gun, moreover, it is prevented reliably that the fixing device 10 or the silencer fixed to the fixing device 10 oscillates in vertical direction after the shot has been fired from the gun. The front portion of the handle 92 no longer is able to swing downwards, because a downward movement is prevented by the fixation rail 30 resting on the counter-support surface of the trigger 97. Thereby, also the rigidity of the handle 92 is increased as a whole.

The counter-support surface may comprise a substantially concave surface. Accordingly, the support surface of the fixation rail 30 corresponding thereto has a convex surface. Of course, it is also possible that the counter-support surface has a substantially convex surface and the support surface has a concave surface corresponding thereto.

In principle, the surfaces of the support surface and of the counter-support surface may be formed arbitrarily. It is important that the two surfaces correspond to each other such that, with a mounted fixing device 10, the support surface of the fixation rail 30 rests on the counter-support surface of the trigger 97, preferably substantially flush, and a downward movement of the rear end 33 of the fixation rail relative to the trigger is prevented.

The blades 35 provided at the rear end 33 of the fixation rail 30 protrude axially at the rear portion 33 of the fixation rail 30. Further, the two blades 35 extend spaced apart from each other and substantially in parallel with respect to each other. The support surface of the fixation rated 30 extends between these two blades 35. The distance of the two blades 35 to each other is selected such that it basically corresponds to the width of the front-sided portion (that portion at which the counter-support surface is located) of the trigger 97. After the fixing device 10 has been pushed completely onto the mounting rail of 94, the two blades 35 extend laterally at the front-sided portion of the trigger 97, and are resting laterally on the trigger. This means that the front-sided portion of the trigger 97 engages substantially flush between the two blades 35. By the engagement of the trigger 97 between the two blades 35, it is ensured that the fixing device 10 swings in horizontal direction, after a shot has been fired from the gun. Further, the rigidity of the handle is even further increased.

By the measures mentioned above, the vibration behavior of the silencer is improved such that also a semi-automatic or a fully automatic operation of the gun is enabled, because the shot channel 20 formed in the fixation plate 12 still runs coaxially with respect to the barrel of the gun after a shot, and does not move relative to the barrel.

FIG. 3 shows the fixing device shown in FIG. 1 in a released state, while the fixing device 10 of FIG. 1 is shown in a locked state.

The two portions of the locking rockers 13 not protruding at the rear end of the fixation rail 30 are pushed inwards such that the two pins 17 are pivoted outwards about the pivot axis 14. The two pins 17 no longer engage with the trigger 97 such that the fixing device 10 can be pulled off the gun.

Here, the side walls 31 can be seen better, which extend parallel to the longitudinal axis of the handle at the top side of the fixation rail 30, and the inner-sided longitudinal guides of which are brought into engagement with the mounting rail 94 of the gun.

Figure 4:
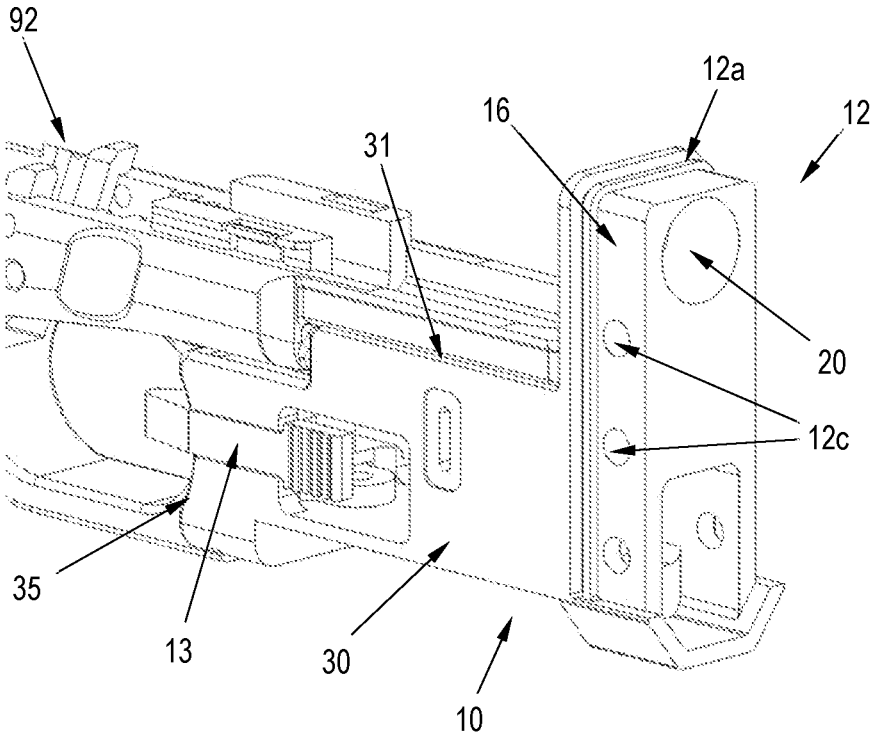
FIG. 4 shows the fixing device shown in FIG. 1 in a perspective oblique front view.

FIG. 4 shows the fixing device of FIG. 1 in a perspective oblique front view.

Here, the circumferential groove 12*a* of the tongue and groove connection extending at the side wall 16 of the fixation plate 12, as well as the shot channel 20 formed in the fixation plate 12 can be seen well.

An internal thread may be provided in the shot channel. Thereby, optionally, the silencer may be fitted on the fixing device 12 by means of the tongue and groove connection, or the silencer may be screwed into the shot channel.

Figure 5:
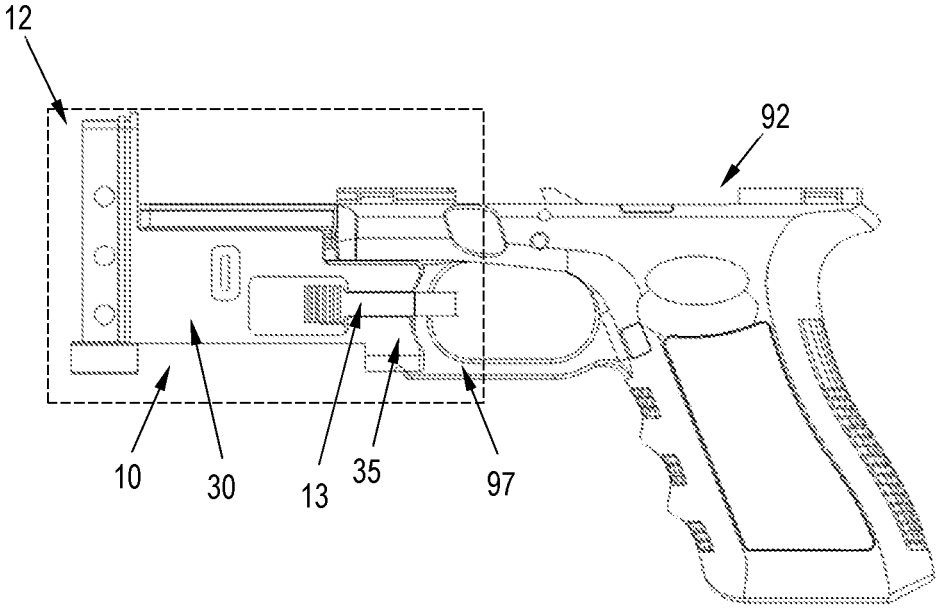
FIG. 5 shows a handle of a gun with a fixing device arranged thereon in a side view.

FIG. 5 shows a handle 92 of a gun with a fixing device 10 arranged thereon in a side view. Here, the end portions of the locking rockers 13 engaging with the trigger 97, and the blades 35, which extend laterally of the trigger 97 can be seen well.

Also, the L-shaped basic form of the fixing device can be seen well, here.

Figure 6:
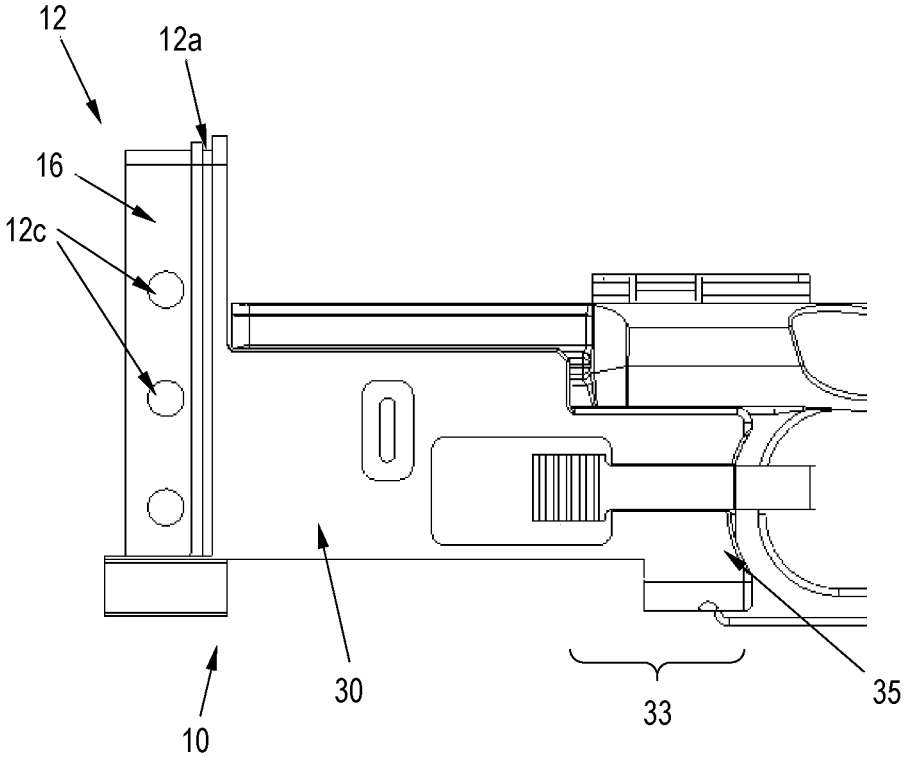
FIG. 6 shows a detailed view of the fixing device which is shown in FIG. 5 in side view.

FIG. 6 shows a detailed view of the fixing device 10 shown in FIG. 5 in a side view, wherein the area framed by the dashed line in FIG. 5 is shown.

Here, the circumferential groove 12*a* at the side wall 16 of the fixation plate 12 can be seen well.

Figure 7:
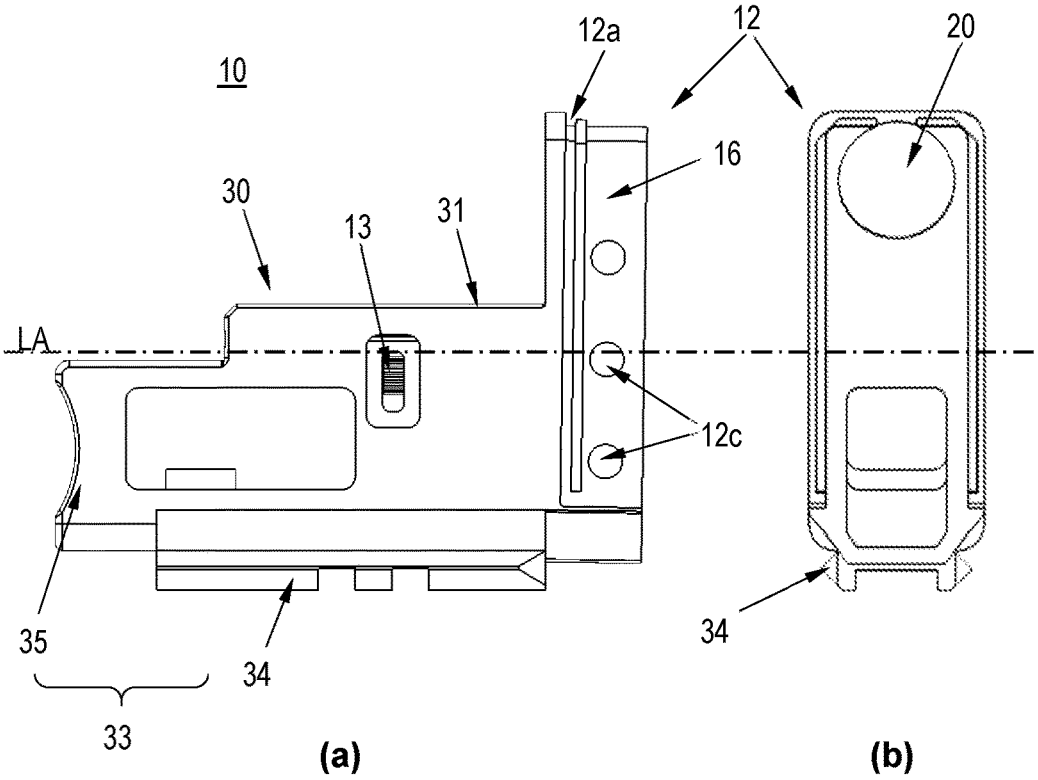
FIG. 7 shows a fixing device in a side view and in a front view.

FIG. 7 shows a fixing device 10 in a side view (figure (a)) and in a front view (figure (b)).

Here, the sidewalls 31 lying at the top side of the fixation rail 30 can be seen well.

Further, the fixing device 10 may comprise a mounting rail 34 at the lower side such that additional auxiliary means, e.g., a light or the like may be fixed there.

Instead of a locking rocker, here, the fixing device 10 comprises a locking pin 13, which extends transversely through the fixation rail 30, and between which the two side walls 31 can be brought into engagement with the mounting rail 94 of the gun. Thereby, an axial movement of the fixing device 10 along the mounting rail 94 of the gun is prevented.

Figure 8:
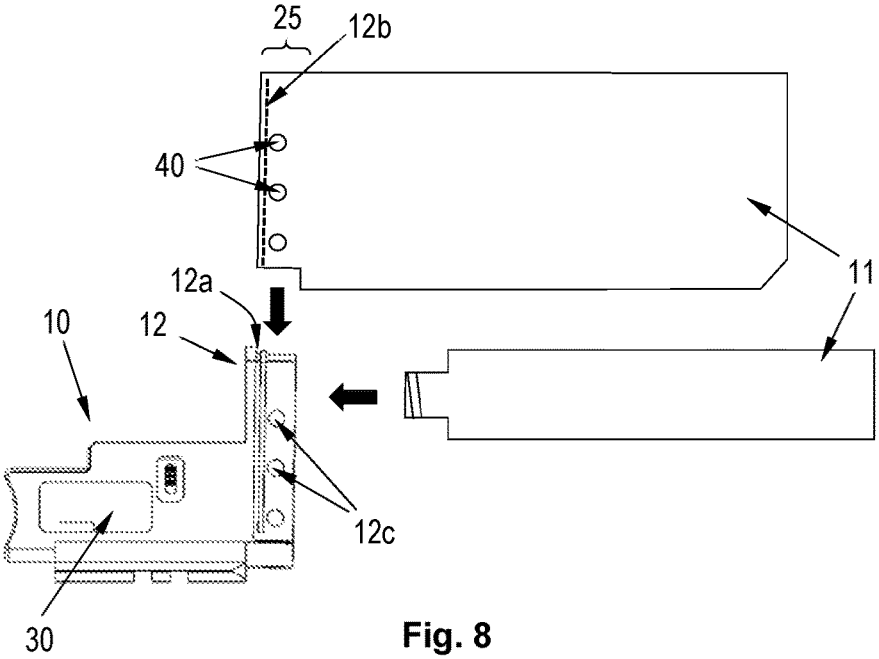
FIG. 8 shows a schematic illustration of a fixing device and of two silencers for illustrating the fixing mechanism.

FIG. 8 shows a schematic illustration of a fixing device 10 and two silencers 11 for illustrating the fixation mechanism.

The upper silencer is connected to the fixation plate 12 of the fixing device 10 by means of the tongue and groove connection. For this, the silencer 11 has a wall 25 protruding axially at the end facing the fixation plate 12. The inner surface of the wall 25 is formed such that after fixing the silencer to the fixation plate 12, it rests flush at the side wall 16 of the fixation plate 12. Further, a circumferential tongue 12*b* of the tongue and groove connection is provided at the inner surface of the wall 25, which is brought into engagement with the groove 12*a* of the fixation plate 12 by pushing the silencer onto the fixation plate 12 from above. The boreholes 40 of the silencer 11, which are also provided in the wall 25, correspond to boreholes 12*c* in the side wall 16 of the fixation plate 12. After pushing the silencer onto the fixation plate 12, bolts may be introduced into the boreholes 40, 12 in order to lock the silencer 11 at the fixation plate 12.

The lower silencer 11 is formed as silencer, which has an external thread as a connecting piece, by means of which the silencer 11 can be screwed into the shot channel 20 of the fixation plate 12. Instead of a silencer, for example, also a plastic bottle may be screwed thereinto.

Figure 9:
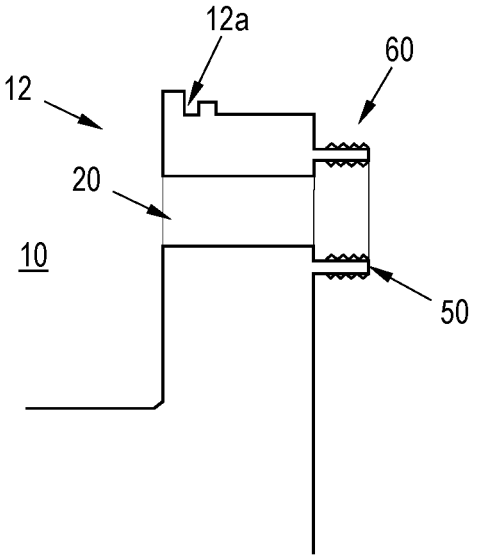
FIG. 9 shows an alternative embodiment of the fixation plate of a fixing device.

FIG. 9 shows an alternative configuration of a fixation plate 12 of a fixing device 10 in a longitudinal section.

At the front side, i.e., at the side facing away from the barrel of the gun, the fixation plate 12 comprises an adapter 60. The adapter 60 is formed as a sleeve-like and axial protrusion 50, which is fixed at the fixation plate 12 coaxially with respect to the shot channel 20 of the fixation plate 12. The fixation plate 12 and the sleeve 50, here, are formed in one piece. An external thread is provided at the cylindrical sleeve 50, at which conventional silencers comprising an internal thread may be screwed mounted.

Alternatively or additionally, the sleeve 50 may also comprise an internal thread. Instead of the threads, also bayonet connections or bayonet-like connections may be provided.

Figure 10A:
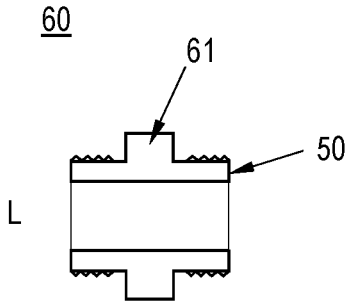
FIGS. 10A-B show two alternative embodiments of an adapter, which can be arranged at the fixation plate.
Figure 10B:
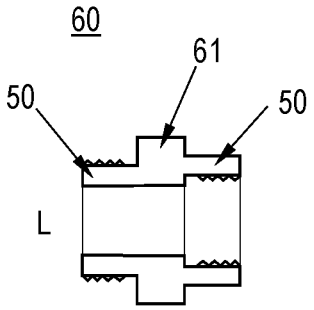

FIGS. 10A-B show two alternative configurations of an adapter 60, which may be fixed to the fixation plate 12 of device 10 releasably.

In FIG. 10A, the adapter 60 basically consists of a pipe-shaped sleeve 50, the inner diameter of which is equal over the entire length, and corresponds at least to the inner diameter of the shot channel 20 of the fixation plate 12.

The sleeve 50 has an external thread at the end portion facing the shot channel 20 of the fixation plate 12, as well as at the end portion facing away from the shot channel 20 of the fixation plate 12. At the fixation plate 12, which may comprise an internal thread in the shot channel 20, thus, also a conventional silencer may be fixed with an internal thread by fixing the silencer to the adapter 60.

Additionally or alternatively to the external thread, the adapter shown in FIG. 10A may also comprise an internal thread at the portion facing the shot channel 20 of the fixation plate 12, in order to, for example, be fixed to the fixation plate 12 shown in FIG. 9.

The adapter 60 in FIG. 10B has two sleeve-like portions 50, whereby the portion L facing the shot channel 20 of the fixation plate 12 has a smaller diameter than the portion facing away from the shot channel 20 of the fixation plate 20. The diameter of the adapter, however, is at least as large as the diameter of the shot channel 20. The portion having the larger diameter, here, has an internal thread, in which, for example, an oil filter or plastic bottles may be fixed.

Additionally or alternatively to the internal thread, the adapter shown in figure (b) may also comprise an external thread at the portion facing away from the shot channel 20 of the fixation plate 12.

The adapter shown in FIG. 10 may also comprise a bayonet connection or bayonet-like connections.

By means of the adapter shown in FIG. 10, silencers or other sound-absorbing devices may be fixed to the fixation plate 12. According to the type of connection, a corresponding adapter may be fixed to the fixation plate 12. Thus, for example, a plurality of adapters 60 can be provided, which respectively have a different inner and/or outer diameter.

The adapter may comprise a radial flange 61 at the outer wall, which may be formed as a circumferential flange according to one configuration of the adapter. The flange is provided, in order to be able to fix the adapter more easily to the fixation plate 12, or in order to fix the adapter tighter to the fixation plate 12. For this purpose, the flange 61 may be configured such that, for example, a fork wrench or a spanner may be set thereon, in order to tighten the adapter.

By the fixing device or by the adapter shown in FIG. 10, a silencer can be fixed to the gun without coupling the silencer to the barrel of the gun. Thus, the barrel is able to move completely independently of the silencer.

Moreover, silencers can also be fixed to those guns, the barrel end of which are not configured so as to fix a silencer thereto. For example, a silencer can also be fixed to such a gun, the barrel end of which does not have an external thread for screw mounting a silencer.

REFERENCE NUMERALS

10 fixing device
11 gun accessories, e.g., silencer or silencer housing
12 fixation plate
12*a* groove of a tongue and groove connection
12*b* tongue of a tongue and groove connection
12*c* boreholes in the fixation plate 12
13 locking rocker/locking pin
14 pivot axis of the locking rocker 13
16 sidewalls of the fixation plate 12
17 pin of the locking rocker 13
20 shot channel
25 axially protruding wall of the silencer 11
30 fixation rail
31 side wall of the fixation rail 30
33 rear end of the fixation rail 30
34 mounting rail at the lower side of the fixing device 10
35 blade at the rear end 33 of the fixation rail 30
40 borehole at the gun accessory 11
50 sleeve

60 adapter
61 flange
92 handle of the gun
94 mounting rail at the lower side of the gun or at the lower side of the handle 92 in the area of the breech
97 trigger of the gun
d thickness of the fixation plate 12
L the end of the barrel facing the adapter 60
LA longitudinal axis of the gun or of the fixing device 10

What is claimed is:

1. A fixing device (10) for fixing silencer (11) to a handgun, wherein the fixing device comprises:

a fixation rail (30) for fixing the fixing device at a mounting rail (94) of the handgun, and a fixation plate (12) arranged at the front end of the fixation rail (30) extending perpendicular with respect to the fixation rail, wherein a shot channel (20) is formed in the fixation plate, which, with the fixing device fixed to the mounting rail (94), extends coaxially with respect to the central axis of the barrel of the gun, wherein the fixation plate (12) comprises a fixation means for fixing the silencer at the fixation plate (12), wherein the fixation means comprises a groove (12*a*) running at least partly circumferentially around the fixation plate (12), or a tongue of a tongue and groove connection running at least partly circumferentially around the fixation plate (12), wherein the groove (12*a*) or the tongue is formed such that a tongue or groove provided at the silencer can be brought into engagement with the groove (12*a*) or tongue of the fixation plate (12), wherein the groove (12*a*) or tongue of the fixation plate (12) is provided at least at two opposing side walls (16) of the fixation plate, wherein the silencer can be pushed on the fixation plate along the groove (12*a*) or the tongue, wherein a locking means is provided at the fixation plate (12) for locking the silencer fixed at the fixation plate, wherein the locking means comprises at least one hole (12*c*) provided at at least one side wall (16), which corresponds to e borehole (40) provided at the silencer, when the silencer is fixed to the fixation plate (12), wherein a safety bolt can be pushed through the hole (12*c*) and through the borehole (40).

2. The fixing device of claim 1, wherein the locking means is formed as a snap lock or as a clip-on connection, which is manipulable manually for releasing the silencer from the fixation plate (12).

3. The fixing device of claim 1, wherein the fixation means comprises an internal thread or a bayonet connection formed in the shot channel (20) of the fixation plate (12), in order to screw mount the silencer on to the fixation plate.

4. The fixing device of claim 1, wherein the fixation plate (12) and the fixation rail (30) are formed in one piece or integrally.

5. The fixing device of claim 1, wherein a support surface is formed at the rear end (33) of the fixation rail (30), which at least in sections rests on the front-sided surface of the trigger (97) of the gun, when the fixing device is fixed to the gun.

6. The fixing device of claim 1, wherein two blades (35) spaced apart from each other are provided at the rear end (33) of the fixation rail (30), which at least in sections protrude in axial direction at the support surface, and which extend perpendicular with respect to the support surface, wherein the distance between the two blades (35) with respect to each other is selected such that it substantially corresponds to the width of the front end of the trigger (97) such that the front end of the trigger (97) engages at least in sections substantially flush between the two blades (35), when the fixing device is fixed to the gun.

7. The fixing device of claim 1, wherein a locking means (13) is provided at the fixation rail (30), in order to lock the fixing device at the gun.

8. The fixing device of claim 7, wherein the locking means comprises at least a locking rocker (13), which is arranged pivotably about a pivot axis (14) at the rear end (33) of the fixation rail (30), and which can be brought into a release position from a locking position, wherein the locking rocker (13) is aligned substantially in parallel with respect to the longitudinal axis (LA) of the fixation rail (30), and in a state of the fixing device being fixed to the gun, can be brought into engagement with the trigger (97) of the gun, in order to lock the fixing device at the gun.

9. The fixing device of claim 1, wherein the fixation plate (12) comprises an adapter (60), which is arranged or which can be arranged coaxially with respect to the shot channel (20) of the fixation plate (12) at the side of the fixation plate facing away from the barrel of the gun, and wherein the adapter comprises connecting means at the end facing away from the shot channel for connecting the adapter (60) to the silencer.

10. The fixing device of claim 9, wherein the adapter (60) and the fixation plate (12) are formed in one piece.

11. The fixing device of claim 9, wherein the adapter (60) can be connected to the fixation plate (12) releasably, wherein the adapter comprises connecting means at the end (L) facing the shot channel for connecting the adapter (60) to the fixation plate.

12. The fixing device of claim 9, wherein the connecting means comprise an internal thread, an external thread, and/or a bayonet connection.

13. A handgun comprising the fixing device (10) of claim 1.

14. The handgun of claim 13, wherein the fixing device (10) and the handgun are formed in one piece or integrally.

15. The handgun of claim 13, wherein a silencer (11) is fixed or can be fixed at the fixing device (10).

* * * * *